US012503278B2

(12) United States Patent
Yu

(10) Patent No.: US 12,503,278 B2
(45) Date of Patent: Dec. 23, 2025

(54) STORAGE BOX WITH IMPROVED FASTENING CONFIGURATION

(71) Applicant: PNP DESIGN CONSULTANT LIMITED, Taipei (TW)

(72) Inventor: Bui Yan Yu, Taipei (TW)

(73) Assignee: PNP DESIGN CONSULTANT LIMITED, Taipei (TW)

( * ) Notice: Subject to any disclaimer, the term of this patent is extended or adjusted under 35 U.S.C. 154(b) by 0 days.

(21) Appl. No.: 18/804,429

(22) Filed: Aug. 14, 2024

(65) Prior Publication Data

US 2025/0058942 A1 Feb. 20, 2025

(30) Foreign Application Priority Data

Aug. 14, 2023 (TW) ..... 112130489

(51) Int. Cl.
*B65D 43/22* (2006.01)
*B65D 43/16* (2006.01)

(52) U.S. Cl.
CPC ..... *B65D 43/22* (2013.01); *B65D 43/162* (2013.01); *B65D 2251/105* (2013.01)

(58) Field of Classification Search
CPC ..... B65D 43/22; B65D 43/162; B65D 2251/105; B65D 43/0204; B65D 2543/00268
See application file for complete search history.

(56) References Cited

U.S. PATENT DOCUMENTS 4,574,951 A 3/1986 Weaver
5,094,355 A * 3/1992 Clark ..... B65D 43/162 220/4.23
5,506,046 A * 4/1996 Andersen ..... B29C 49/0412 524/498
2009/0057381 A1* 3/2009 Gokhale ..... B65D 1/26 229/406
2013/0327770 A1* 12/2013 Turvey ..... B65D 43/021 220/787
2014/0263353 A1* 9/2014 Bell ..... B65D 5/4295 229/148
2015/0329265 A1* 11/2015 Birgen ..... B65D 81/26 53/410
2021/0114779 A1* 4/2021 Bontrager ..... B65D 43/021

FOREIGN PATENT DOCUMENTS

DE 8028238 U1 6/1981
FR 1193761 A 11/1959

* cited by examiner

*Primary Examiner* — Shawn M Braden
(74) *Attorney, Agent, or Firm* — CKC & Partners Co., LLC

(57) ABSTRACT

A storage box includes a container portion and a lid portion. The container portion includes two lug parts and a gap defined therebetween. One side of each of the lug parts is formed with a lower elongated slit, and the lower elongated slits are coaxial with each other, and communicated with the gap. The lid portion includes a buckle piece bendably connected to one side of the lid portion, and two upper elongated slits are coaxial and opposite to each other. Each upper elongated slit is located between the upper main body and the buckle piece. When the lid portion covers the container portion, the buckle piece is bent into the gap, the upper elongated slits and the lower elongated slits are connected to each other, the buckle piece is abutted against the lug parts, and the lug parts are abutted against the buckle piece.

20 Claims, 8 Drawing Sheets

STORAGE BOX WITH IMPROVED FASTENING CONFIGURATION

CROSS-REFERENCE TO RELATED APPLICATION

This application claims priority to Taiwan Application Serial Number 112130489, filed Aug. 14, 2023, which is herein incorporated by reference.

BACKGROUND

Field of Invention

The present disclosure relates to a storage box. More particularly, the present disclosure relates to a storage box with improved fastening configuration.

Description of Related Art

In present, meals can be contained by a disposable food box (e.g., a lunch box, hamburger boxes) which is portable. Due to environmental factors and human health factors, the disposable food box has been improved from a plastic box to a paper box with a wax layer coated thereon, and next, the disposable food box is improved to be made through a pulp molded manner.

For example, refer to FIG. 1 and FIG. 2, the disposable food box 100 includes a lid 10 and a container 11, and the lid 10 is able to cover the container 11. The food box 100 is mainly provided with two triangular lugs 110*a* on an outer edge of the container 11, and a buckle piece 101 protruding from the outer edge of the lid 10 and corresponding to a gap 110 between the two triangular lugs 110*a*. The buckle piece 101 has two triangle-like clips 101*a* at both ends of the buckle piece 101. The buckle piece 101 of the cover body 10 can be pressed down (FIG. 1) into the gap 110. Thus, the triangle-like clips 101*a* of the lid 10 are located below the triangular lugs 110*a*, and a cross engaging force could be reluctantly provided for stopping against the buckle piece 101 by the triangular lugs 110*a*.

However, when the food box 100 with excessed food therein is carried by a customer, vibration or extrusion by the customer might squeeze the food box 100 to weaken the fastening strengths of the lid 10 and the container 11. Thus, once the lid 10 is unfastened from the container 11, food in the food box might be spilled out. Hence, it can be seen that the cross engaging force of the food box is actually insufficient, and users still need to wrap it with rubber bands (not shown) or tapes so as to avoid the lid from being detached and the food from being exposed and spilled outwardly. Thus, the above-mentioned condition might cause problems of purchase cost of rubber bands and environmental pollution.

Therefore, the above-mentioned technologies obviously still have inconveniences and defects, which are issues that the industry needs to solve urgently.

SUMMARY

One aspect of the present disclosure is to provide a storage box with improved fastening configuration for solving the difficulties mentioned above in the prior art.

In one embodiment of the present disclosure, a storage box with improved fastening configuration includes a container portion and a lid portion. The container portion includes a lower main body and at least one lug set. The lug set includes two lug parts jointly protruding from one side of the lower main body, and a gap defined between the lug parts. One side of each of the lug parts is formed with a lower elongated slit, and the lower elongated slits of the lug parts are coaxial with each other, and in communication with the gap. The lid portion includes an upper main body movably covered the lower main body, at least one buckle piece bendably connected to one side of the upper main body, and arranged correspondingly to the gap, and two upper elongated slits located opposite to each other, and coaxial with each other. Each of the upper elongated slits is located between the upper main body and the at least one buckle piece. When the buckle piece is bent into the gap and the upper elongated slits and the lower elongated slits are connected to each other, the buckle piece is allowed to be abutted against the lug parts, and the lug parts are allowed to be abutted against the buckle piece, respectively.

In one embodiment of the present disclosure, a storage box with improved fastening configuration includes a container portion and a lid portion. The container portion includes a lower main body, a lower recess and at least one lug set. The lower recess is formed on one surface of the lower main body. The lug sets are respectively located on different sides of the lower main body. Each of the lug sets includes two lug parts. The lug parts of each of the lug sets are spaced apart from each other, so that a gap is defined between the lug parts. A lower elongated slit is formed on one side of each of the lug parts of each of the lug sets, and the lower elongated slits of the lug parts of each of the lug sets are coaxial with each other and in communication with the corresponding gap between of the lug parts. The lid portion includes an upper main body and a plurality of buckle pieces. The upper main body removably covers the container portion and the lower recess, and able to be completely detached from the lower main body. The buckle pieces are bendably connected to different sides of the upper main body, and respectively corresponding to the gaps of the lug sets. Each of the buckle pieces is formed with two upper elongated slits at two opposite sides thereof, and the upper elongated slits of each of the buckle pieces are coaxial with each other. When the buckle pieces are respectively bent into the gaps of the lug sets, through the upper elongated slits of each of the buckle pieces are connected to the lower elongated slits of one of the lug sets, each of the buckle pieces is allowed to be abutted against the lug parts of one of the lug sets, and the lug parts of each of the lug sets are allowed to be abutted against one of the buckle pieces, respectively.

Thus, through the construction of the embodiments above, the storage box with improved fastening configuration is able to improve the fastening strengths of these fastening configuration, so that the lid portion and the container portion can be quickly fastened together to avoid the object received therein from being exposed and spilled outwardly when being vibrated or squeezed by users.

The above description is merely used for illustrating the problems to be resolved, the technical methods for resolving the problems and their efficacies, etc. The specific details of the present disclosure will be explained in the embodiments below and related drawings.

The above description is only an overview of the technical solution of the present disclosure. In order to understand the technical means of the present disclosure, and implement the technical means according to the content of the description, and in order to make the above and other objects, features and advantages of the present disclosure more obvious and understandable, preferred embodiments are specifically cited below and described in detail with reference to the accompanying drawings.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 2:
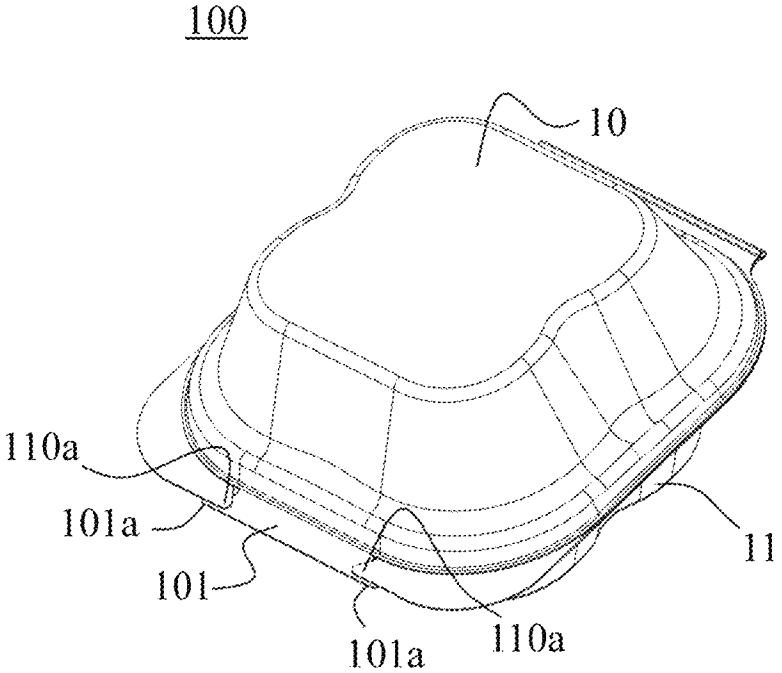
Fig. 2 (Prior Art)
FIG. 2 is a schematic view of the lid and the container of the conventional food box being engaged and fixed with each other.
Figure 1:
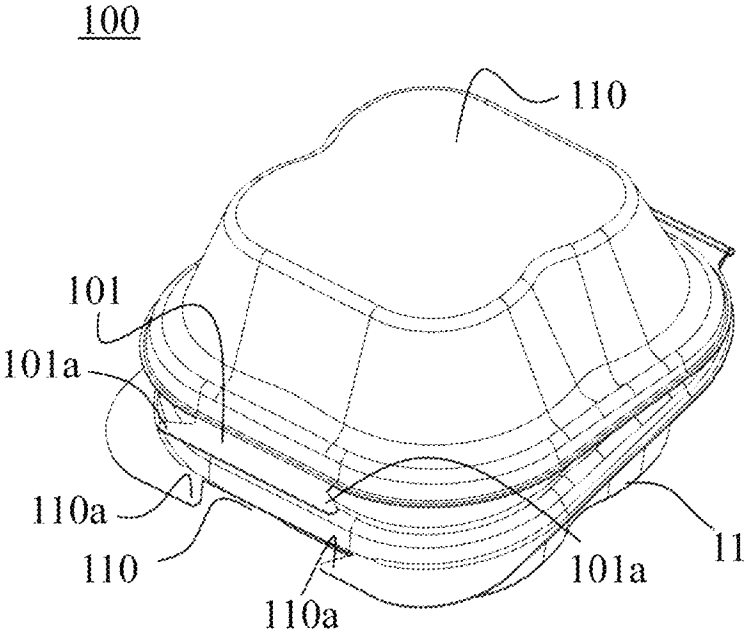
Fig. 1 (Prior Art)
FIG. 1 is a perspective view of a conventional food box.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 3:
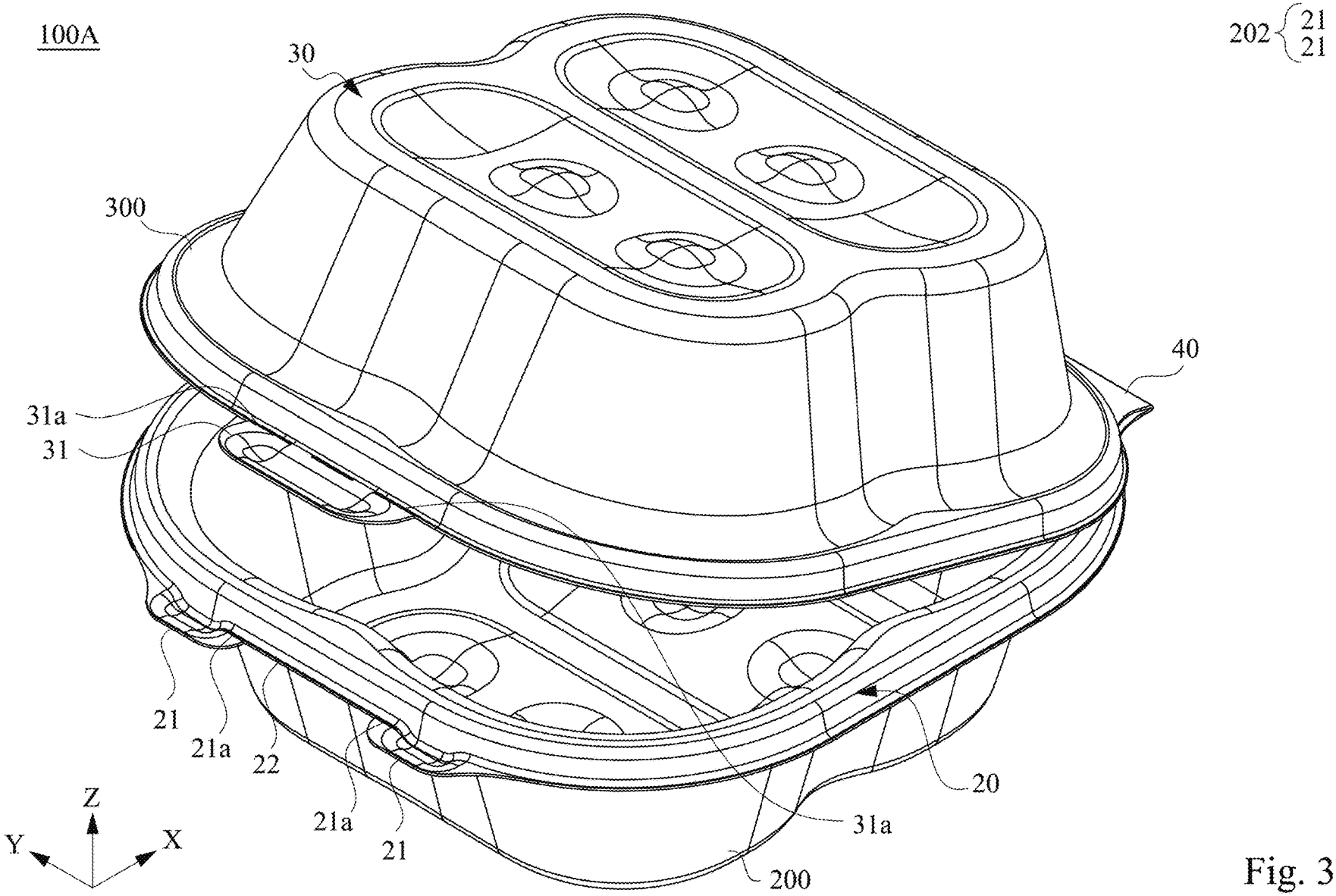
FIG. 3 is a perspective view of a storage box with improved fastening configuration according to one embodiment of the present disclosure.
Figure 4:
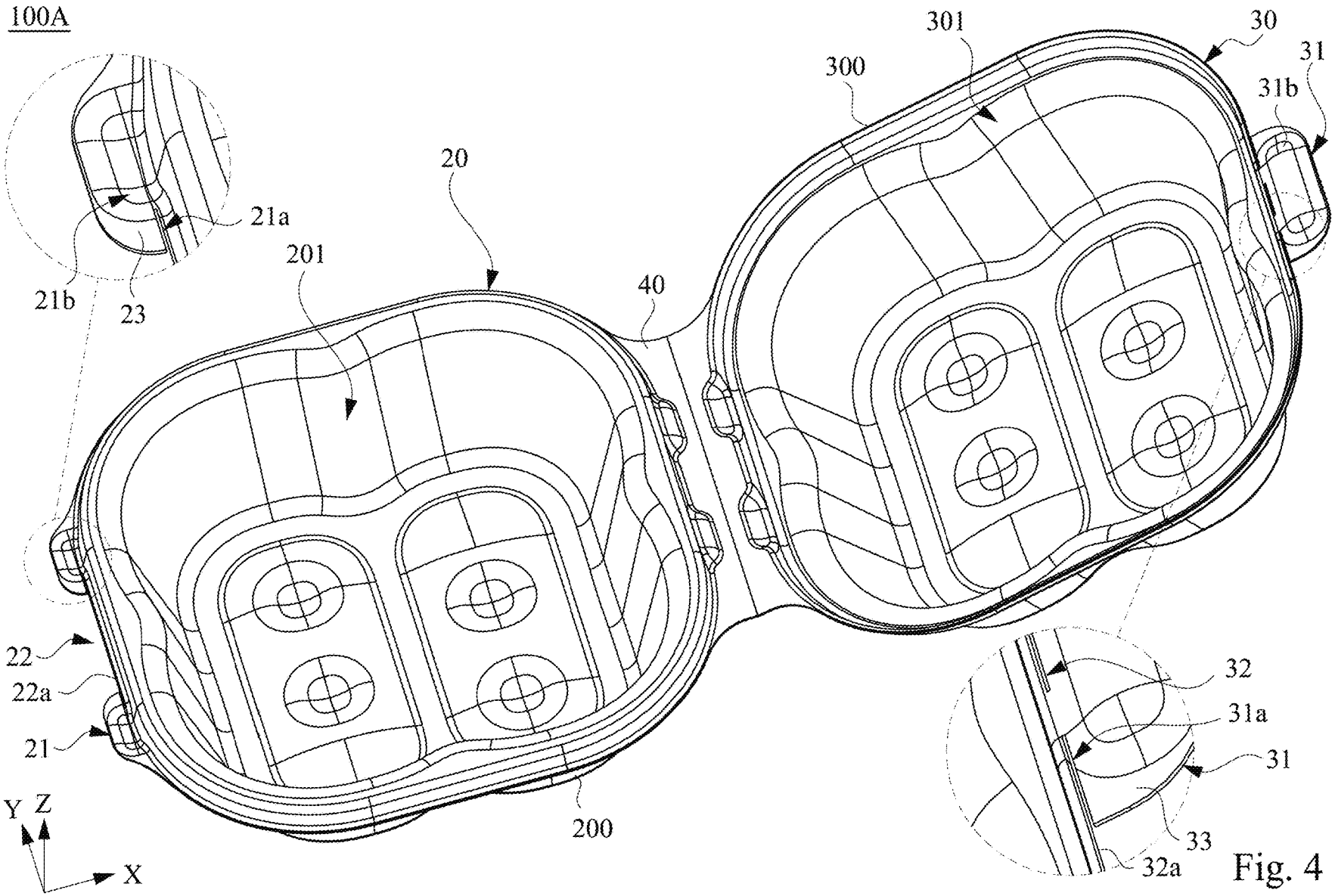
FIG. 4 is a schematic view of the storage box of FIG. 3 in an open state, and enlarged views of two specific areas in FIG. 4.

Reference is now made to FIG. 3 to FIG. 4, in which FIG. 3 is a perspective view of a storage box 100A with improved fastening configuration according to one embodiment of the present disclosure, and FIG. 4 is a schematic view of the storage box 100A of FIG. 3 in an open state, and enlarged views of two specific areas in FIG. 4. In this embodiment, as shown in FIG. 3 and FIG. 4, the storage box 100A with improved fastening configuration includes a container portion 20, a lid portion 30 and a connection portion 40. The container portion 20 includes a lower main body 200, a lower recess 201 and a lug set 202. The lower recess 201 is formed on one surface of the lower main body 200. The lug set 202 includes two lug parts 21 spaced arranged on one side of the lower main body 200, and a gap 22 formed between the lug parts 21. The lug parts 21 jointly protrude from the same side of the lower main body 200, and the gap 22 is defined by the lug parts 21 and the lower main body 200. For example, each of the lug parts 21 laterally extends outwards from an outer edge 22*a* of the side of the lower main body 200. One side of each of the lug parts 21 is formed with a lower elongated slit 21*a*, and the lower elongated slits 21*a* of the lug parts 21 are coaxial with each other and in communication with the gap 22 formed between the lug parts 21. Specifically, each of the lower elongated slits 21*a* is partially cut on the lug parts 21, so that one free end portion (also called as a first tail portion 23, hereinafter) of the lug part 21 which is flexible, is defined by the corresponding lower elongated slit 21*a* and the gap 22. In other words, the aforementioned lower elongated slits 21*a* are respectively formed on inner sides of the lug parts 21 which are faced with each other, and the lower elongated slits 21*a* are connected to the outer edge 22*a* of the side of the lower main body 200. In this embodiment, the dimensions of the lower elongated slits 21*a* are in millimeter-levels. The length of the lower elongated slits 21*a* is, for example, 0.5-0.8 mm. However, there disclosure is not limited thereto.

It is noted, since the lower elongated slits 21*a* are formed on the lug parts 21, when the temporarily physical deformation of each of the lug parts 21 has been occurred, each of the lower elongated slits 21*a* allows the corresponding first tail portion 23 described above to be physically deformed in response to the changes of physically deforming force on one of the lug parts 21, and allows the corresponding first tail portion 23 to be physically rebounded back to its original position when the temporarily deformation is vanished.

The lid portion 30 includes an upper main body 300, an upper recess 301, a buckle piece 31 and two upper elongated slits 31*a*. The upper main body 300 is flappable on the lower main body 200. The upper recess 301 is recessed on one surface of the upper main body 300. However, the disclosure is not limited thereto, in another embodiment, the lid portion 30 may be in a plate shape without the upper recess 301 mentioned above. The buckle piece 31 is bendably connected to one side of the upper main body 300, and arranged correspondingly to the gap 22. For example, the buckle piece 31 laterally extends outwards in a lateral direction (e.g., X axis) away from an outer edge 32*a* of the side of the upper main body 300. The upper elongated slits 31*a* are located opposite to each other, and coaxial with each other. Each of the upper elongated slits 31*a* is located between the upper main body 300 and the buckle piece 31, in other words, the upper elongated slits 31*a* separates the upper main body 300 and the buckle piece 31. Specifically, the upper elongated slits 31*a* are partially cut on the buckle piece 31, respectively, so that two free end portions (also called as second tail portions 33, hereinafter) of the buckle piece 31 which are flexible, are formed. In another embodiment, the upper elongated slits 31*a* may also be directly formed on the buckle piece 31, rather than being the partition slit between the buckle piece 31 and the upper main body 300.

It is noted, since the upper elongated slits 31*a* are formed on the buckle piece 31, when the temporarily physical deformation of the buckle piece 31 has been occurred, each of the upper elongated slits 31*a* allows the corresponding second tail portion 33 described above to be physically deformed in response to the changes of physically deforming force on the buckle piece 31, and allows the corresponding second tail portion 33 to be physically rebounded back to its original position when the temporarily deformation is vanished.

In this embodiment, the size of the lower main body 200 and the upper main body 300 are approximately the same, and the dimensions of the upper elongated slits 31*a* are in millimeter-levels. The length of the upper elongated slits

31*a* is, for example, 0.8 mm. However, there disclosure is not limited thereto. The connection portion 40 is integrally connected to the container portion 20 and the lid portion 30, and opposite to the lug set 202 so that the lid portion 30 is flappable to the container portion 20.

Specifically, each of the lower elongated slits 21*a* is in a lined shape, and the lower elongated slits 21*a* are connected to the outer edge 22*a* of the side of the lower main body 200. A long axis direction (e.g., Y axis) of each of the lower elongated slits 21*a* is parallel to a long axis direction (e.g., Y axis) of the outer edge 22*a* of the side of the lower main body 200. Each of the upper elongated slits 31*a* is in a lined shape, and the upper elongated slits 31*a* are connected to the outer edge 32*a* of the side of the upper main body 300. A long axis direction (e.g., Y axis) of each of the upper elongated slits 31*a* is parallel to a long axis direction (e.g., Y axis) of the outer edge 32*a* of the side of the upper main body 300.

Also, the buckle piece 31 is further provided with a broken line 32. The broken line 32 is located between the upper elongated slits 31*a*, and between the upper main body 300 and the buckle piece 31. A long axis direction (e.g., Y axis) of the broken line 32 is coaxial with a long axis direction (e.g., Y axis) of each of the upper elongated slits 31*a*.

Furthermore, one surface of each of the lug parts 21 is provided with a protruding portion 21*b*. The protruding portion 21*b* protrudes downwardly along Z axis direction for enhancing the structural strength of the lug parts 21. One surface of the buckle piece 31 is provided with a protruding portion 31*b*. The protruding portion 31*b* protrudes downwardly along Z axis direction for enhancing the structural strength of the buckle piece 31.

One with ordinary skill in the art of the disclosure may appropriately adjust the numbers of the lug set 202 and the buckle piece 31 in time according to the sizes of the container portion 20 and the lid portion 30 or the fastening requirements of multi-sided of the container portion 20 and the lid portion 30.

For example, when the lug set 202 and the buckle piece 31 are plural, the lug sets 202 are respectively located on different sides or the same side of the container portion 20, and the buckle pieces 31 are respectively located on different sides or the same side of the lid portion 30.

Figure 5A:
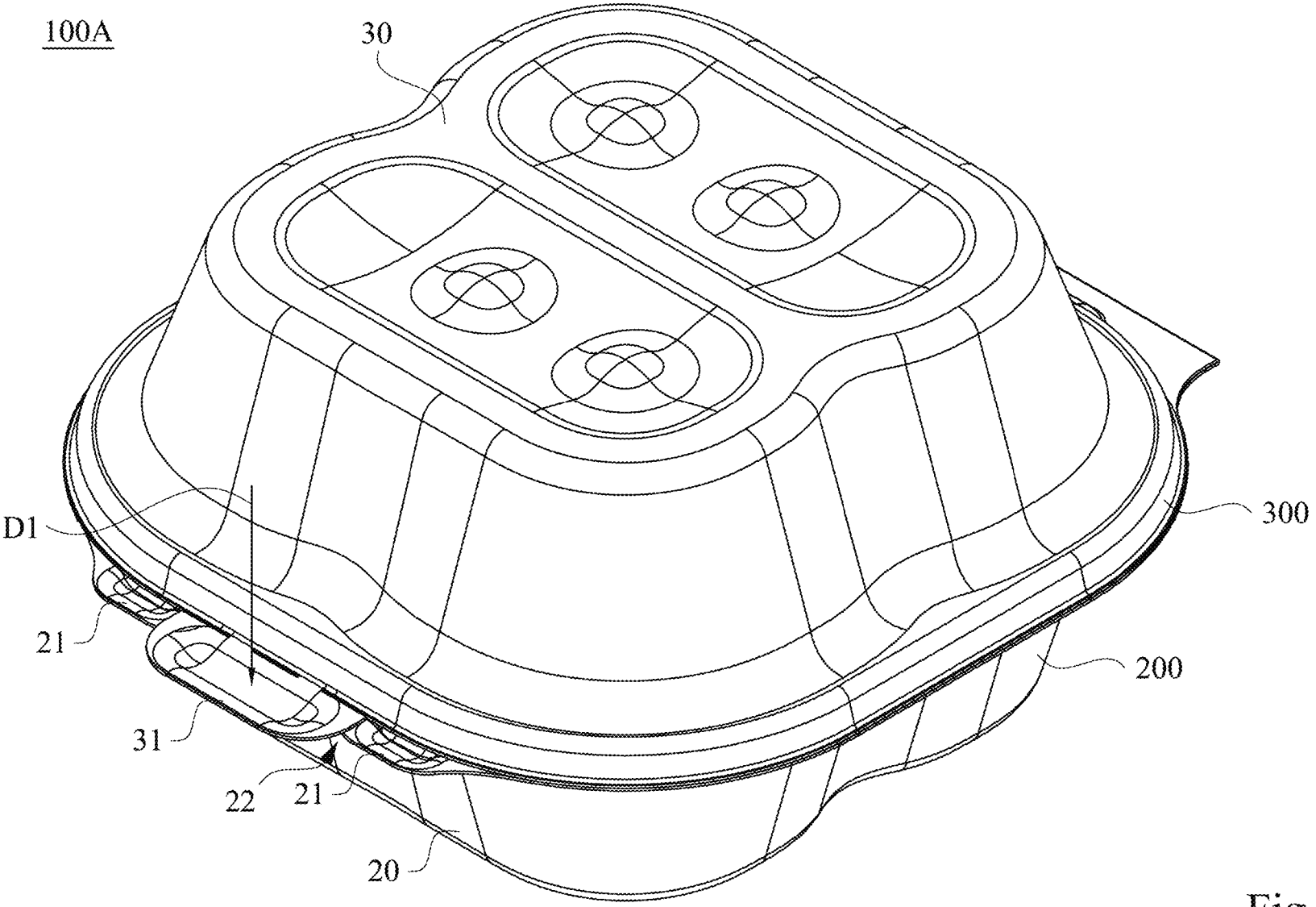
FIG. 5A and FIG. 5B are continuous operation views of the container portion and the lid portion in FIG. 3 being fastened to each other.
Figure 5B:
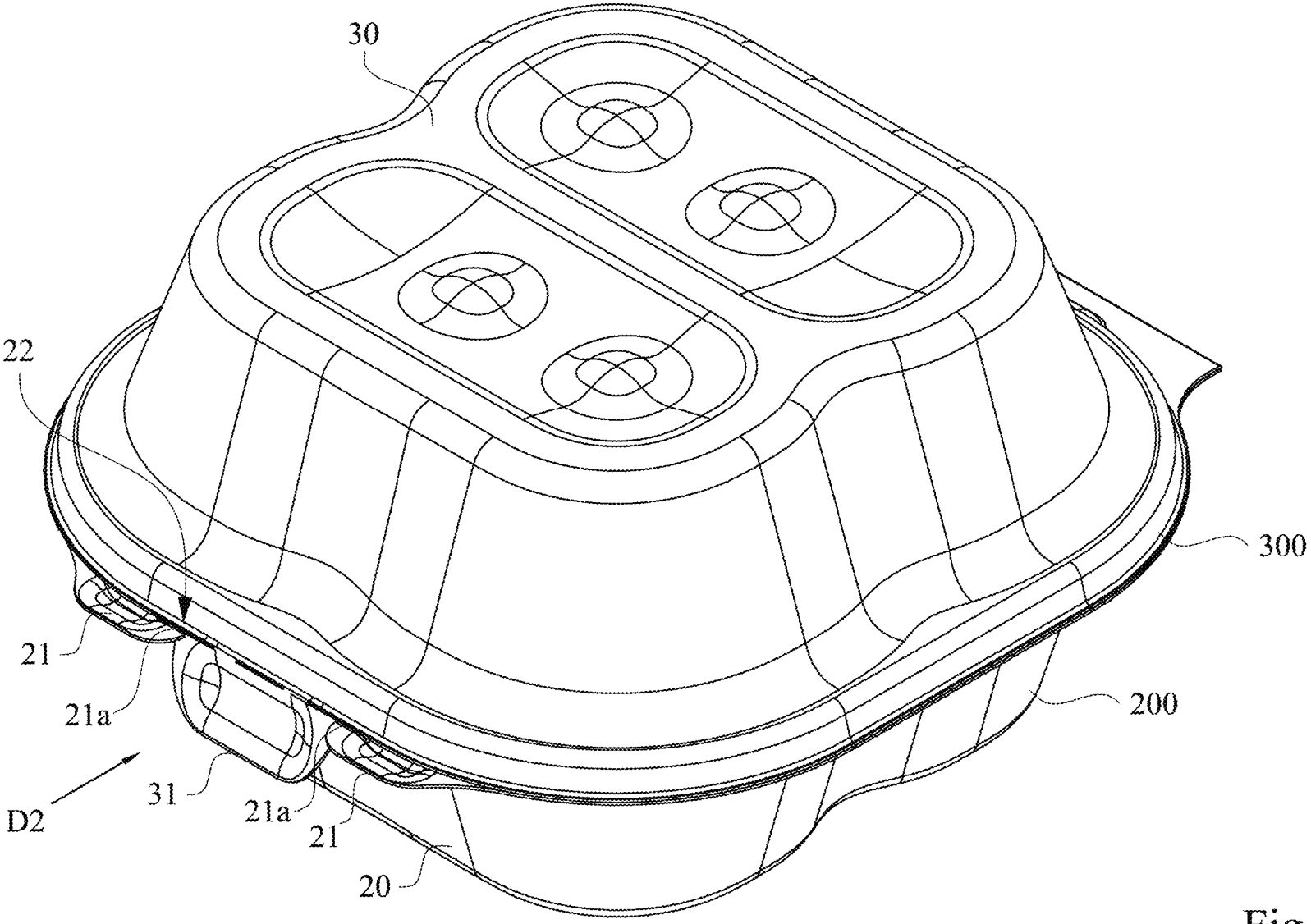
Figure 6:
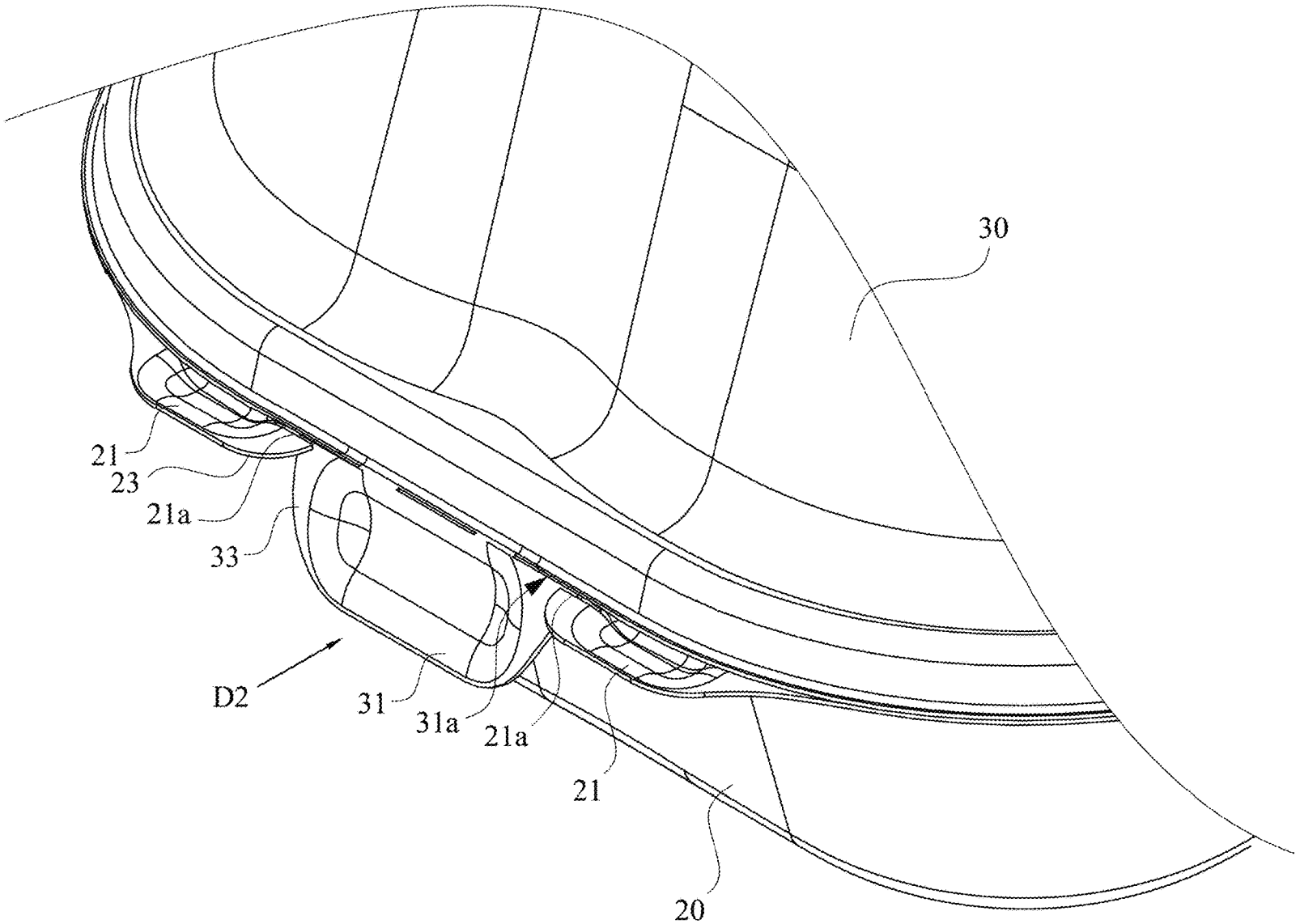
FIG. 6 is an enlarged view of the container portion 20 and the lid portion in FIG. 5B being fastened to each other.

FIG. 5A and FIG. 5B are continuous operation views of the container portion 20 and the lid portion 30 in FIG. 3 being fastened to each other. FIG. 6 is an enlarged view of the container portion 20 and the lid portion 30 in FIG. 5B being fastened to each other. As shown in FIG. 5A, FIG. 5B and FIG. 6, when a user rotates the lid portion 30 to cover the container portion 20 in the direction D1 (FIG. 5A), so that the upper recess 301 and the lower recess 201 are in communication together to form a receiving chamber (not shown in figures) capable of receiving an object such as meal, food and likes. Thus, the storage box 100A can also be implemented as a food box in this embodiment. However, the disclosure is not limited to the usage of the storage box 100A.

Next, the user bends the buckle piece 31 of the lid portion 30 into the gap 22 of the container portion 20 in the direction D2 (FIG. 5B), so that the upper elongated slits 31*a* and the lower elongated slits 21*a* are connected to each other, thus, the buckle piece 31 is allowed to be abutted against the lug parts 21, and the lug parts 21 are allowed to be abutted against the buckle piece 31, respectively. More specifically, when the buckle piece 31 is rotated into the gap 22 (FIG. 5B), the second tail portions 33 and the first tail portions 23 are collectively physically deformed, that is, when a physically deforming force is applied on the buckle piece 31, the first tail portions 23 of the lug parts 21 are pressed by the second tail portions 33 of the buckle piece 31, and the second tail portions 33 of the buckle piece 31 are pressed by the first tail portions 23 of the lug parts 21. Until the upper elongated slits 31*a* and the lower elongated slits 21*a* are connected to each other, the second tail portions 33 are physically rebounded back to its original position when the temporarily deformation is vanished (FIG. 4) so that the second tail portions 33 are snapped into the corresponding lower elongated slits 21*a*. Thus, the second tail portions 33 are stopped and positioned limited by the first tail portions 23, and the first tail portions 23 are stopped and positioned limited by the second tail portions 33, respectively. Hence, the lid portion 30 and the container portion 20 can be quickly fastened together to avoid the object received therein from being exposed and spilled outwardly when being vibrated or squeezed by users. On the contrary, the user can quickly open the lid portion 30 from the container portion 20 reversely according to the above sequence (FIG. 4).

Figure 7:
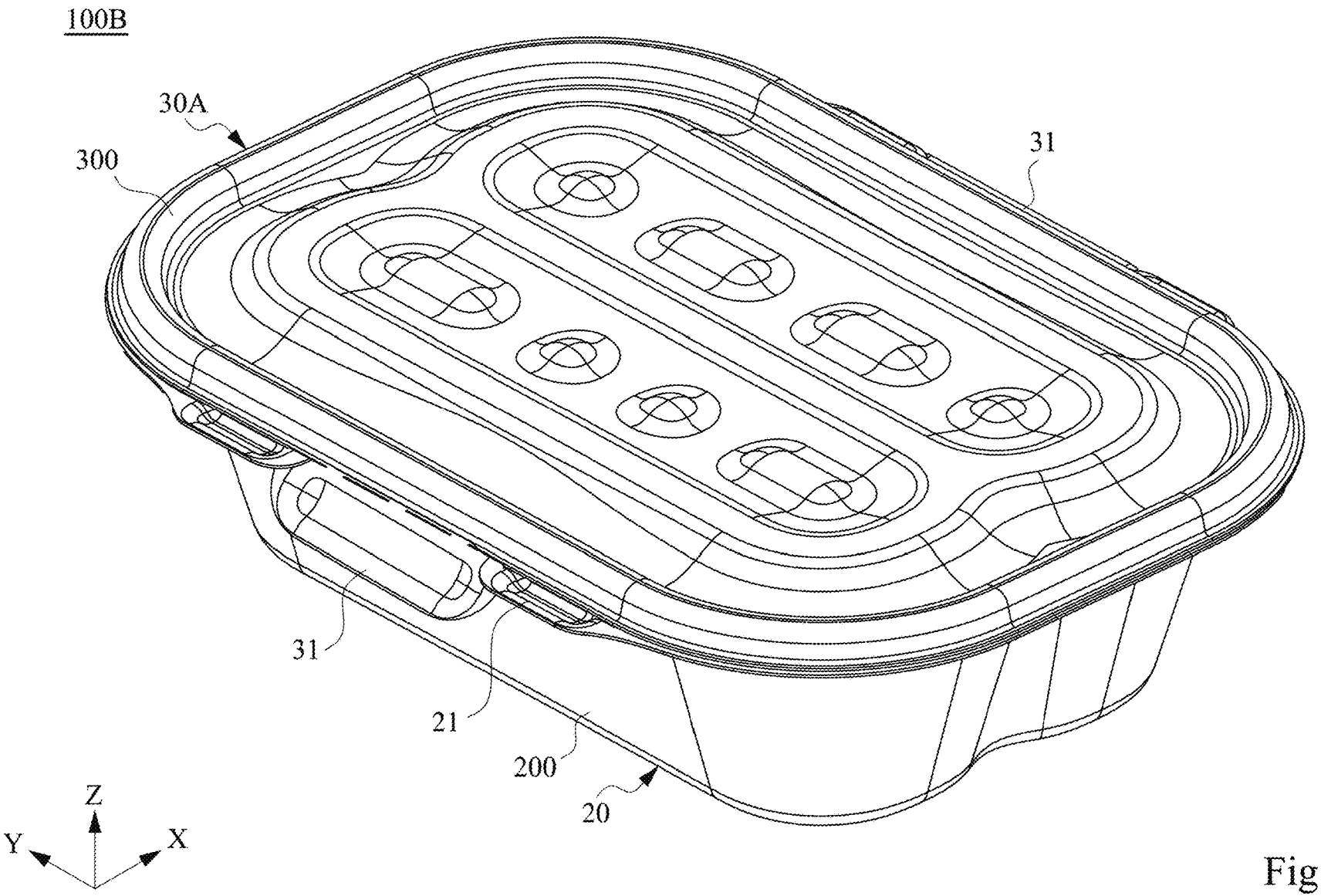
FIG. 7 is a perspective view of a storage box with improved fastening configuration according to one embodiment of the present disclosure.
Figure 8:
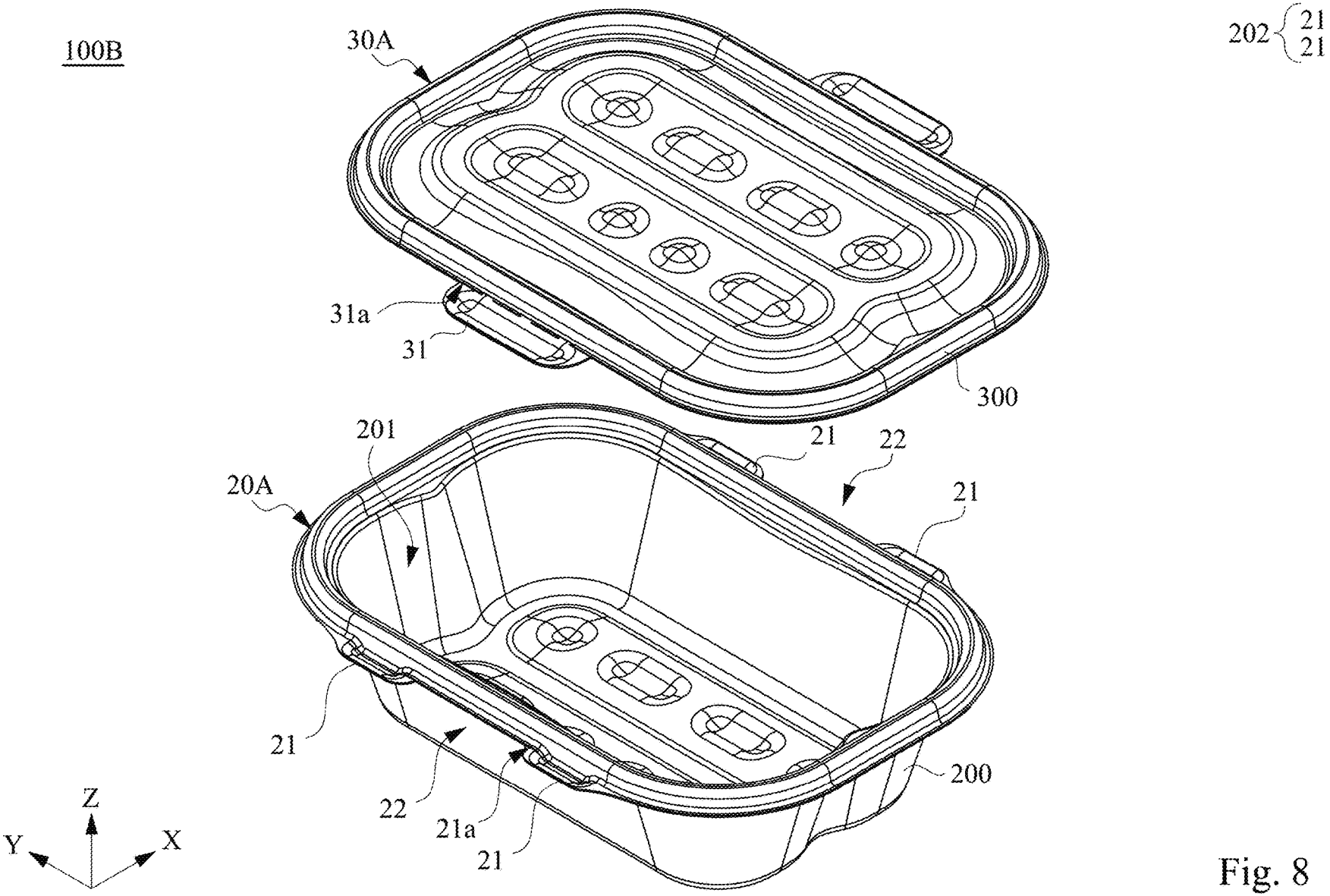
FIG. 8 is a schematic view of the storage box of FIG. 7 in an open state.

FIG. 7 is a perspective view of a storage box 100B with improved fastening configuration according to one embodiment of the present disclosure. FIG. 8 is a schematic view of the storage box 1001B of FIG. 7 in an open state. As shown in FIG. 7 and FIG. 8, the storage box 100B of this embodiment is substantially the same to the storage box 100A of FIG. 3 mentioned above. However, one of the differences between the storage box 100B in FIG. 7 and the storage box 100A of FIG. 3 is that the lid portion 30A is able to be completely detached from the container portion 20A so that the aforementioned connection portion 40 in the embodiment can be omitted. Specifically, the upper main body 300 removably covers the container portion 20A and the lower recess 201, and able to be completely detached from the lower main body 200.

Furthermore, another of the differences between the storage box 100B in FIG. 7 and the storage box 100A of FIG. 3 is that the lid portion 30A in FIG. 7 is in a plate shape without an upper recess. Thus, when the lid portion 30A covers the container portion 20A and the lower recess 201, the lower recess 201 is solely defined to be the aforementioned receiving chamber (not shown in figures) by the lid portion 30A and the container portion 20A.

In addition, the container portion 20A further includes a plurality (e.g., two) of lug sets 202. The lug sets 202 are respectively located on the different sides of the lower main body 200. For example, in this embodiment, the lug sets 202 are located on two opposite sides (e.g., long sides) of the lower main body 200.

The lid portions 30A further includes a plurality (e.g., two) of buckle pieces 31. The buckle pieces 31 are respectively located on the different sides of the upper main body 300. The buckle pieces 31 are located on two opposite sides of the upper main body 300. For example, in this embodiment, the buckle pieces 31 are extended in opposite directions (e.g., X axis) away from each other, and the upper elongated slits 31*a* mentioned above are respectively formed on two opposite sides of each of the buckle pieces 31.

To sum up, through the construction of the embodiments above, the storage box with improved fastening configuration is able to improve the fastening strengths of these fastening configuration, so that the lid portion and the container portion can be quickly fastened together to avoid the object received therein from being exposed and spilled outwardly when being vibrated or squeezed by users.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of this disclosure provided they fall within the scope of the following claims and their equivalents.

What is claimed is:

1. A storage box with improved fastening configuration, comprising:

a container portion comprising:

a lower main body; and at least one lug set comprising two lug parts jointly protruding from one side of the lower main body, and a gap that is defined between the lug parts, wherein one side of each of the lug parts is formed with a lower elongated slit, and the lower elongated slits of the lug parts are coaxial with each other and in communication with the gap;

a lid portion comprising:

an upper main body movably covered the lower main body;

at least one buckle piece bendably connected to one side of the upper main body, and arranged correspondingly to the gap; and two upper elongated slits located opposite to each other, and coaxial with each other, wherein each of the upper elongated slits is located between the upper main body and the at least one buckle piece, wherein when the at least one buckle piece is bent into the gap and the upper elongated slits and the lower elongated slits are connected to each other, the at least one buckle piece is allowed to be abutted against the lug parts, and the lug parts are allowed to be abutted against the at least one buckle piece, respectively.

2. The storage box with improved fastening configuration of claim 1, wherein each of the lower elongated slits is in a lined shape, and the lower elongated slits are connected to an outer edge of the one side of the lower main body, and each of the upper elongated slits is in a lined shape, and the upper elongated slits are connected to an outer edge of the one side of the upper main body.

3. The storage box with improved fastening configuration of claim 1, wherein the at least one buckle piece is further provided with a broken line, the broken line is located between the upper elongated slits, and between the upper main body and the at least one buckle piece, wherein a long axis direction of the broken line is coaxial with a long axis direction of each of the upper elongated slits.

4. The storage box with improved fastening configuration of claim 1, wherein the at least one buckle piece is extended outwards in a lateral direction away from the one side of the upper main body.

5. The storage box with improved fastening configuration of claim 1, wherein one surface of each of the lug parts is provided with a protruding portion.

6. The storage box with improved fastening configuration of claim 1, wherein one surface of the at least one buckle piece is provided with a protruding portion.

7. The storage box with improved fastening configuration of claim 1, wherein the at least one lug set comprises a plurality of lug sets located at one of the one side and different sides of the lower main body; and the at least one buckle piece comprises a plurality of buckle pieces located at one of the one side and different sides of the upper main body.

8. The storage box with improved fastening configuration of claim 1, wherein one surface of the upper main body is recessed with an upper recess, and one surface of the lower main body is recessed with a lower recess, wherein when the lid portion covers the container portion, the upper recess and the lower recess are in communication together to form a receiving chamber capable of receiving an object.

9. The storage box with improved fastening configuration of claim 1, wherein the lid portion is in a plate shape.

10. The storage box with improved fastening configuration of claim 1, further comprising:

a connection portion integrally connected to the container portion and the lid portion, and opposite to the at least one lug set so that the lid portion is flappably disposed on the container portion.

11. The storage box with improved fastening configuration of claim 1, wherein the lid portion is able to be completely detached from the container portion.

12. A storage box with improved fastening configuration, comprising:

a container portion comprising:

a lower main body;

a lower recess formed on one surface of the lower main body; and a plurality of lug sets respectively located on different sides of the lower main body, and each of the lug sets comprising two lug parts, the two lug parts of each of the lug sets are spaced apart from each other, so that a gap is defined between the two lug parts, wherein a lower elongated slit is formed on one side of each of the two lug parts of each of the lug sets, and the lower elongated slits of the two lug parts of each of the lug sets are coaxial with each other and in communication with the corresponding gap between of the two lug parts;

a lid portion comprising:

an upper main body removably covering the container portion and the lower recess, and able to be completely detached from the lower main body; and a plurality of buckle pieces bendably connected to different sides of the upper main body, and respectively corresponding to the gaps of the lug sets, wherein each of the buckle pieces is formed with two upper elongated slits at two opposite sides thereof, and the upper elongated slits of each of the buckle pieces are coaxial with each other, wherein when the buckle pieces are respectively bent into the gaps of the lug sets, through the upper elongated slits of each of the buckle pieces are connected to the lower elongated slits of one of the lug sets, each of the buckle pieces is allowed to be abutted against the two lug parts of one of the lug sets, and the two lug parts of each of the lug sets are allowed to be abutted against one of the buckle pieces, respectively.

13. The storage box with improved fastening configuration of claim 12, wherein the lug sets are oppositely arranged on the lower main body, and the buckle pieces are oppositely arranged on the upper main body.

14. The storage box with improved fastening configuration of claim 12, wherein each of the lower elongated slits of the lug sets is in a lined shape, and the lower elongated slits of the lug sets are connected to an outer edge of the lower main body; and each of the upper elongated slits of each of the buckle pieces is in a lined shape, and the upper elongated slits of each of the buckle pieces are connected to an outer edge of the upper main body.

15. The storage box with improved fastening configuration of claim 12, wherein each of the buckle pieces is further provided with a broken line, wherein a long axis direction of the broken line is coaxial with a long axis direction of each of the upper elongated slits of each of the buckle pieces.

16. The storage box with improved fastening configuration of claim 12, wherein the buckle pieces are extended in opposite directions away from each other.

17. The storage box with improved fastening configuration of claim 12, wherein one surface of each of the lug parts is provided with a protruding portion.

18. The storage box with improved fastening configuration of claim 12, wherein one surface of each of the buckle pieces is provided with a protruding portion.

19. The storage box with improved fastening configuration of claim 12, wherein the lid portion is in a plate shape.

20. The storage box with improved fastening configuration of claim 12, wherein the lid portion is recessed with a recess on one surface of the upper main body.

* * * * *